US005387446A

United States Patent [19]

Weder

[11] Patent Number: 5,387,446

[45] Date of Patent: Feb. 7, 1995

[54] RIBBON ASSEMBLY FORMING CURVED SEGMENT FOR MAKING A BOW OR RUFFLE

[75] Inventor: Donald E. Weder, Highland, Ill.

[73] Assignee: Highland Supply Corporation, Highland, Ill.

[21] Appl. No.: 101,210

[22] Filed: Aug. 3, 1993

[51] Int. Cl.[6] ..... B32B 9/00

[52] U.S. Cl. ..... 428/4; 428/5; 428/24; 428/26; 428/101; 428/906; 223/46; 156/70

[58] Field of Search ..... 428/4, 5, 25, 24, 26, 428/101, 136, 152, 198, 131, 906; 156/70; 223/46

[56] References Cited

U.S. PATENT DOCUMENTS

| | | | |
|---|---|---|---|
| 2,841,905 | 7/1958 | Wanchek . | |
| 2,849,821 | 9/1958 | Doig | 41/10 |
| 2,869,264 | 1/1959 | Salmi | 41/10 |
| 3,030,719 | 4/1962 | Enomoto | 41/10 |
| 3,041,765 | 7/1962 | Paar | 41/10 |
| 3,539,431 | 11/1970 | Schmidt | 161/9 |
| 3,632,464 | 1/1972 | Grikis | 161/9 |
| 3,637,455 | 1/1972 | Pearson | 161/9 |
| 3,676,277 | 7/1972 | Truskolaski | 161/9 |
| 3,954,212 | 5/1976 | Bolis | 223/46 |
| 4,329,382 | 5/1982 | Truskolaski et al. | 428/4 |
| 4,449,652 | 5/1984 | Coppins et al. | 223/46 |
| 4,476,168 | 10/1984 | Aoyama | 428/4 |
| 4,515,837 | 5/1985 | Cheng | 428/4 |
| 4,585,676 | 4/1986 | Desmet | 428/5 |
| 4,608,283 | 8/1986 | White | 428/4 |
| 4,634,612 | 1/1987 | Nelson | 428/4 |
| 4,656,064 | 4/1987 | Cheng | 428/4 |
| 4,684,552 | 8/1987 | Labrosse et al. | 428/4 |
| 4,724,175 | 2/1988 | Labrosse et al. | 428/4 |
| 4,725,461 | 2/1988 | Masui | 428/4 |
| 4,777,066 | 10/1988 | White et al. | 428/4 |
| 4,812,338 | 3/1989 | Masui | 428/4 |
| 4,822,648 | 4/1989 | Cheng | 428/4 |

*Primary Examiner*—Patrick J. Ryan
*Assistant Examiner*—Abraham Bahta
*Attorney, Agent, or Firm*—Dunlap, Codding & Lee

[57] ABSTRACT

A ribbon assembly including a strip of material divided into segments. A material having a stretched condition and an unstretched condition is disposed on one surface of the strip of material and extends along a length of the strip of material. In the stretched condition, the strip of material extends in a substantially straight line. In the unstretched condition, each segment of the strip of material is formed into a curved segment for making a ruffle or bow.

The present invention also contemplates the use of an adhesive or cohesive for holding the strip of material in the form of the bow.

9 Claims, 2 Drawing Sheets

RIBBON ASSEMBLY FORMING CURVED SEGMENT FOR MAKING A BOW OR RUFFLE

FIELD OF THE INVENTION

The present invention relates generally to ribbon assemblies for making bows and ruffles and more particularly, but not by way of limitation, to a strip of material having means disposed thereon with a stretched condition and an unstretched condition wherein said means forms curved segments in the strip of material in the unstretched condition.

DESCRIPTION OF THE PREFERRED EMBODIMENTS

Figure 1:
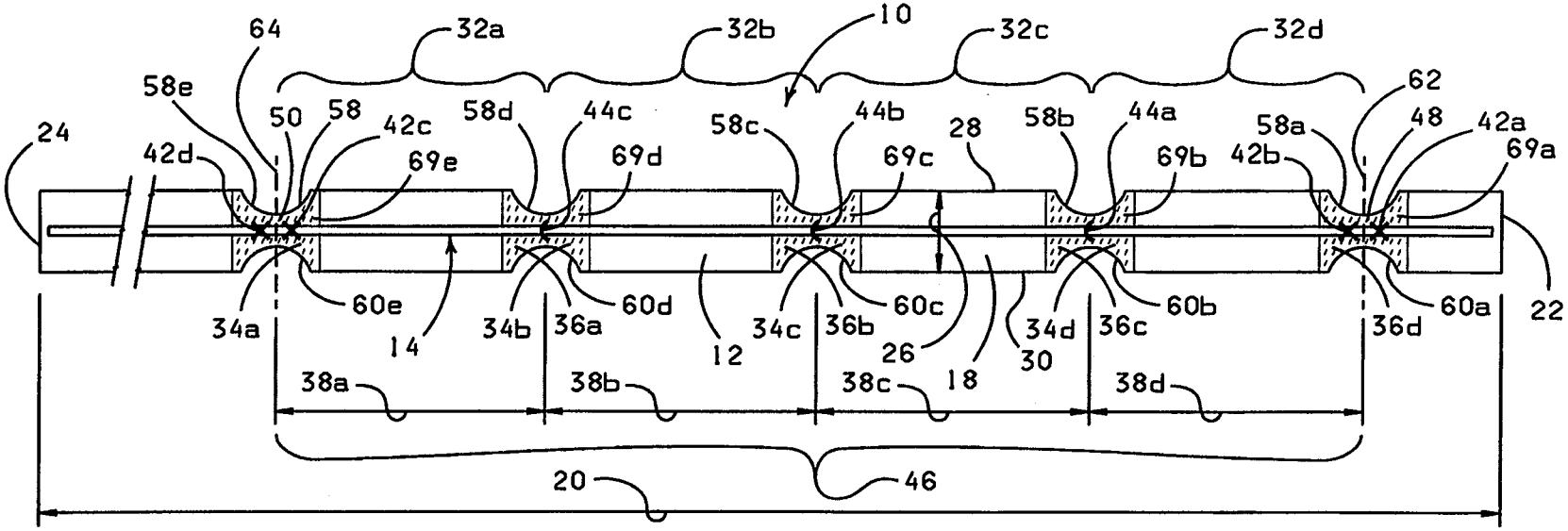
FIG. 1 is a plan view showing a ribbon assembly constructed in accordance with the present invention comprising a strip of material and means disposed on the strip of material having a stretched condition and an unstretched condition with said means being shown in the stretched condition.
Figure 3:
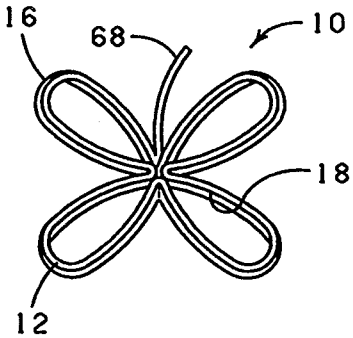
FIG. 3 is a view similar to FIG. 2 showing the strip of material with said means in the unstretched condition and with the strip of material being cut along different cut lines as compared to the portion of the strip of material shown in FIG. 2.
Figure 2:
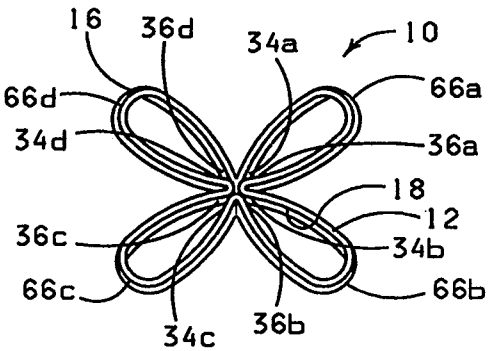
FIG. 2 is a top plan view of a portion of the ribbon assembly of FIG. 1 with said means being shown in the unstretched condition forming curved segments in the strip of material.

Shown in FIG. 1 is a ribbon assembly 10 constructed in accordance with the present invention. The ribbon assembly 10 includes a strip of material 12 having a stretchable assembly 14 disposed thereon. The stretchable assembly 14 has a stretched condition (FIG. 1) and an unstretched condition (FIGS. 2 and 3). In the stretched condition of the stretchable assembly 14, the strip of material 12 is disposed in a flat condition extendable in about a straight line, as shown in FIG. 1. The stretchable assembly 14 is moveable from the stretched condition to the unstretched condition and as the stretchable assembly 14 is moved from the stretched condition to the unstretched condition, the stretchable assembly 14 somewhat automatically forms curved segments in the strip of material 12 which form the strip of material 12 into a bow or ruffle like structure. In short, the ribbon assembly 10 of the present invention is adapted to somewhat automatically form the strip of material into a bow or ruffle like structure.

The strip of material 12 may be constructed of any material commonly used in the art for making ribbons, such as plastic film or cloth (natural or synthetic or combinations thereof) or any other material which can be moved from a flat condition to a condition having curved segments in the manners to be described in greater detail below.

The strip of material 12 has an upper surface 16 (FIGS. 2 and 3) and a lower surface 18 (FIGS. 1, 1A, 2 and 3). The strip of material 12 has a strip length 20 (FIG. 1) extending between a first strip end 22 and a second strip end 24 (FIG. 1). The strip of material 12 has a strip width 26 (FIG. 1) extending between a first strip side 28 (FIG. 1) and a second strip side 30 (FIG. 1).

The strip of material 12 is divided into a plurality of strip segments 32 (four strip segments 32 being shown in FIG. 1 and designated therein by the individual reference numerals 32*a*, 32*b*, 32*c* and 32*d*). Each of the strip segments 32 has a first segment end 34 (the individual first segment ends 34 being shown in FIG. 1 and designated therein by the individual reference numerals 34*a*, 34*b*, 34*c* and 34*d*). Each of the strip segments 32 also has a second segment end 36 (the individual second segment ends 36 being designated in FIG. 1 by the individual reference numerals 36*a*, 36*b*, 36*c* and 36*d*). Each of the strip segments 32 has a segment length 38 extending between the respective first segment end 34 and the respective second segment end 36. The individual segment lengths 38 are shown in FIG. 1 and designated therein by the individual reference numerals 38*a*, 38*b*, 38*c* and 38*d*).

In the embodiment shown in FIG. 1, the segment lengths 38 are about equal. In some embodiments, the segment lengths 38 may be varied or different to provide different effects (appearances in the resulting bow or ruffle).

As shown in FIG. 1, the second segment end 36 of each of the strip segments 32 is disposed adjacent the first segment end 34 of the adjacent strip segment 32. The strip segments 32 are spaced along the strip length 20 between the first strip end 22 and the second strip end 24.

The stretchable assembly 14 is disposed on the lower surface 18 of the strip of material 12. The stretchable assembly 14 more particularly comprises a stretchable material such as an elastic band or a shrinkable material such as a heat shrinkable plastic film for example. In the case of a heat shrinkable film, the stretched condition refers to the film in an unshrunk condition and the unstretched condition refers to the film in a shrunk condition after heat has been applied to the heat shrinkable film. Heat shrinkable films are well known in the art.

It should be noted that, although the stretchable assembly 14 sometimes will be referred to below as an elastic band 14, the present invention is not limited to a stretchable assembly 14 in the form of an elastic band. It also should be noted that, although the elastic band or stretchable assembly 14 is shown in FIG. 1 as being disposed between the first strip side 28 and the second strip side 30 with the elastic band 14 being much smaller than the strip width 26, the stretchable assembly 14 may be disposed on the lower surface 18 and extend between the first strip side 28 and a second strip side 30 if desired in a particular application.

The elastic band 14 extends between the first strip end 22 and the second strip end 24. The elastic band 14 is connected to the strip of material 12 at connection points. More particularly, the elastic band 14 is securedly connected to the strip of material 12 at secure connection points 42 (the individual secure connection points 42 being designated in FIG. 1 by the individual reference numerals 42*a*, 42*b*, 42*c* and 42*d*. The elastic band 14 is loosely or slidably connected to the strip of material 12 at the loose connection points 44 with the individual loose connection points 44 being designated in FIG. 1 by the individual references 44*a*, 44*b* and 44*c*.

A plurality of the strip segments 32 define a bow segment 46 (FIG. 1) having a first bow end 48 (FIG. 1) and a second bow end 50 (FIG. 1). The stretchable assembly or elastic material 14 is connected to the strip of material 12 at two spaced apart positions by way of the secure connection points 42*a* and 42*b* at the first bow end 48. The stretchable assembly or elastic material 14 is connected to the strip of material 12 at two spaced apart positions by way of secure connection points 42*c* and 42*d* at the second bow end 50. The stretchable assembly or elastic material 14 is connected to the strip of material 12 between the strip segments 32 comprising the bow segment 46 at the lose connection points 44*a*, 44*b* and 44*c*.

The stretchable assembly or elastic material 14 may be connected to the strip of material 12 by way of secure connection points 42 by adhesively connecting the stretchable assembly or elastic material 14 to the strip of material 12 or the stretchable assembly or elastic material 14 may be stitched to the strip of material 12 at the secured connection points 42.

Figure 1B:
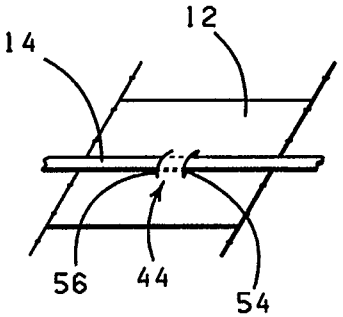
FIG. 1B is a plan view of a segment of the strip of material of FIG. 1 showing a typical loose connection point for connecting the stretchable assembly to the strip of material.
Figure 1A:
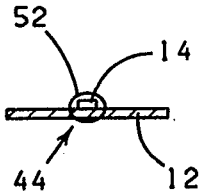
FIG. 1A is a sectional view of the sheet of material shown in FIG. 1 showing a typical loose connection point for connecting the stretchable assembly to the strip of material.

The stretchable assembly or elastic material 14 may be connected to the strip of material 12 via the loose connection points 44 by a loop 52 (FIG. 1*a*) of stitching material or thread extended through the strip of material 12 and looped over the stretchable assembly or elastic material 14. In the alternative, the loose connection points 44 may be formed by cutting slits 54 and 56 (FIG. 1*b*) in the strip of material 12 and extending the stretchable assembly or elastic material 14 through the slit 54 and under the strip of material 12 and back through the slit 56 with the stretchable assembly or elastic material 14 being slidably disposed in the slit 54 and 56. In the alternative, the loose connection points may be formed by securing a length of material at its opposite ends to the strip of material 12 forming a loop and the stretchable assembly or elastic material 14 may be extended through the loop.

A plurality of spaced apart recesses or cut outs 58 (FIG. 1) are formed through the first strip side 28 with each of the recesses 58 being positioned between two adjacent strip segments 32. The individual recesses 58 are designated in FIG. 1 by the specific reference numerals 58*a*, 58*b*, 58*c*, 58*d* and 58*e*.

A plurality of recesses or cut outs 60 (FIG. 1) are formed through the second strip side 30 with each of the recesses 60 being positioned between two adjacent strip segments 32 and each of the recesses 60 being generally aligned with one of the recesses 58. The individual recesses 60 are shown in FIG. 1 and designated by the individual reference numerals 60*a*, 60*b*, 60*c*, 60*d* and 60*e*.

When it is desired to form a bow or ruffle, the strip of material 12 is cut along the cut line 62 at the first bow end 48 and along a cut line 64 at the second bow end 50 thereby providing the bow segment 46. The bow segment 46 has the stretchable assembly or elastic band 14 secured at the first bow end 48 via the secure connection point 42*b* and secured at the second bow end 50 via the secure connection point 42*c*.

The stretchable assembly or elastic band 14 is secured between the strip segments 32 forming the bow segment 46 at the loose connection points 44*a*, 44*b* and 44*c*. When the first bow end 48 and the second bow end 50 are released thereby releasing the stretchable assembly or elastic band 14, the elastic band 14 contracts or moves toward an unstretched condition with the elastic band 14 slidingly moving through the loose connection points 44*a*, 44*b* and 44*c* as the elastic band 14 contracts or moves toward the unstretched condition.

As the elastic band 14 moves toward the unstretched condition, the first segment end 34 of each of the strip segments 32 is moved toward the second segment end of the respective strip segment 32 to form a curved segment 66 with the individual curved segments 66 being shown in FIG. 2 and designated therein by the individual reference numerals 66*a*, 66*b*, 66*c* and 66*d*. Each of the strip segments 32 in the bow segment 36 forms one of the curved segments 66 when the stretchable assembly 14 is moved from the stretched condition to the unstretched condition. More particularly, the strip segment 32*a* forms the curved segment 66*a*, the strip segment 32*b* forms the curved segment 66*b*, the strip segment 32*c* forms the curved segment 66*c* and the strip segment 32*d* forms the curved segment 66*d*. The curved segments 66*a*, 66*b*, 66*c* and 66*d* are disposed adjacent each other and form a ribbon (or in some instances a ruffle) like the structure shown in FIG. 2.

When the stretchable assembly or elastic band 14 is released, the ribbon like structure shown in FIG. 2 automatically is formed simply by releasing the stretchable assembly 14 generally at the bow ends 48 and 50. In the alternative, if the stretchable assembly 14 is a heat shrinkable material, heat is applied to the heat shrinkable material which shrinks or moves to the unstretched condition thereby forming the curved segments 66 in a manner like that described before with respect to the elastic band stretchable assembly 14. The degree to which the first segment ends 34 are moved toward the second segment ends 36 depends upon the ability of the heat shrinkable material stretchable assembly 14 to shrink or the degree to which the elastic band stretchable assembly 14 is stretched and then unstretched.

In any event, after the stretchable assembly 14 has been moved to the unstretched condition, the bow thus formed can be applied to a package or a plant pot or other object to provide a bow ornamentation. In addition, the curved segments 66 may be tied with an additional strip of material (not shown) wrapped about the recesses 58 and 60 and the curved segments 66 then could be moved or manipulated in a manner like that done in forming bows in a conventional way to form a more decorative bow or a bow of a different shape.

The strip of material 12 also includes adhesive 69 disposed on the lower surface 18 of the strip of material. More particularly, the adhesive 69 is applied to the lower surface 18 of the strip of material 12 at a plurality of spaced apart positions generally about the segment ends 34 and 36. The individual adhesive portions 69 being designated in FIG. 1 by the respective reference numerals 69*a*, 69*b*, 69*c*, 69*d* and 69*e*.

When the strip of material 12 is formed into the bow in the manner described before with respect to FIGS. 2 and 3, the adhesive 69 cooperates to connect the first segment end 34 to the second segment end 36 of each of the strip segments 32 and thereby cooperates to secure the strip of material 12 in the form of the curved segments 66 forming the bow in the unstretched condition of the stretchable assembly 14.

Shown in FIG. 3 is a bow formed from the ribbon assembly 10 shown in FIG. 1 in a manner like the bow formed as shown in FIG. 2, except the strip of material 14 has been cut along a different cut line to leave one loose end 68 forming a ribbon like structure which would hang from the bow to provide additional decoration if desired.

EMBODIMENT OF FIGS. 4 AND 5

Figure 5:
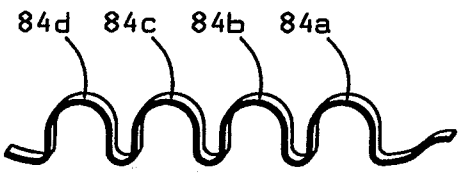
FIG. 5 is a top plan view of a portion of the strip of material shown in FIG. 4 with said means being shown in the unstretched condition.
Figure 4:
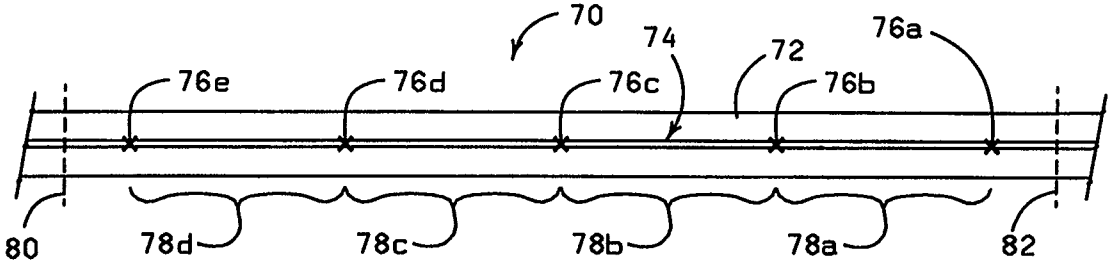
FIG. 4 is a plan view of a modified ribbon assembly showing a modified strip of material with means disposed thereon having a stretched condition and an unstretched condition with said means being shown in the stretched condition.

Shown in FIGS. 4 and 5 is a modified ribbon assembly 70 which is constructed exactly like the ribbon assembly 10 described in detail before and includes a strip of material 72 with a stretchable assembly 74 connected thereto. The strip of material 72 is constructed exactly like the strip of material 12 described in detail before, except the strip of material 72 does not include recesses like the recesses 58 and 60.

The stretchable assembly 74 extends along the strip of material 72 and is connected to the lower surface via a plurality of spaced apart secured connections points 76 with the individual secured connection points being designated in FIG. 4 by the individual reference numerals 76*a*, 76*b*, 76*c*, 76*d* and 76*e*. The secured connection points 76 are effected in a manner like the secured connection points 42 described before, except the secured connection points 76 are disposed between each of a plurality of strip segments 78 with the individual strip segments being designated by the reference numeral 78*a*, 78*b*, 78*c* and 78*d* in FIG. 4.

When the strip of material 72 is cut along the cut lines 80 and 82 and the stretchable assembly 74 is released to move toward the unstretched condition, each of the strip segments 78 is formed into a curved segment 84 in a manner like that described before with respect to the curved segments 66 except the segment ends (like the segment ends 34 and 36) are spaced further apart forming a more ruffled effect such as shown in FIG. 5. The curved segments 84 are designated by the individual reference numerals 84*a*, 84*b*, 84*c* and 84*d* in FIG. 5.

EMBODIMENT OF FIGS. 6 AND 7

Figure 7:
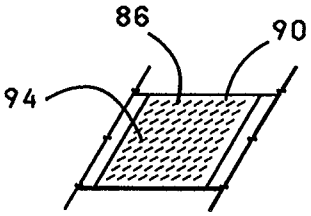
FIG. 7 is a fragmentary view of the strip of material of FIG. 6, but showing the opposite surface with cohesive means disposed thereon.
Figure 6:
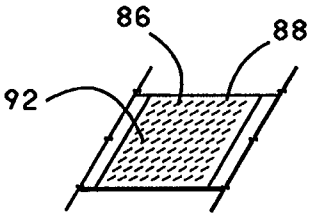
FIG. 6 is a fragmentary view of another modified ribbon assembly showing a plan view of a modified strip of material having cohesive means disposed thereon.

Shown in FIGS. 6 and 7 is a strip of material 86 (only a fragmentary portion of the strip of material 86 being shown in FIGS. 6 and 7) which is constructed exactly like the strip of material 12 or 72 described in detail before as part of a ribbon assembly such as the ribbon assembly 10 or 70 described before. The strip of material 86 has an upper surface 88 (FIG. 6) and a lower surface 90 (FIG. 7). In this embodiment, the strip of material includes a cohesive material 92 (FIG. 6) on the upper surface 88 and a cohesive material 94 (FIG. 7) on the lower surface 90 thereof. In this manner, when the strip of material 86 is rolled into a roll of material, the cohesive material 92 cohesively contacts and adheres to the cohesive material 94 to hold the strip of material and the stretchable assembly in the stretched condition while it is in the rolled form.

EMBODIMENT OF FIG. 8

Figure 8:
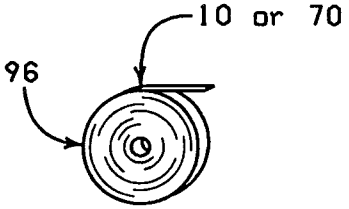
FIG. 8 is a diagrammatic, side elevational view of a ribbon assembly constructed in accordance with the present invention and shown in a roll form.

Shown in FIG. 8 is the ribbon assembly 10 or 70 wherein the strip of material 12 or 72 has been rolled in the form of a roll 96. The strips of material 12 or 72 may be embodied in the form of the roll 96 and a length of the strip of material 12 or 72 may be unrolled from the roll and cut therefrom to form the bow segments for forming the bows or ruffles in the manner as described herein.

EMBODIMENT OF FIGS. 9 AND 10

Figure 10:
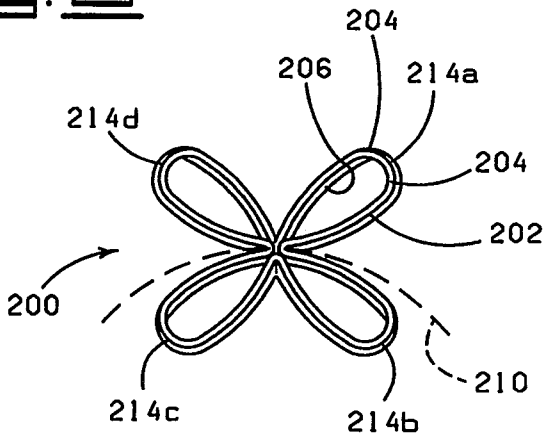
FIG. 10 is a top plan view of a bow constructed utilizing the pull bow ribbon assembly of FIG. 9.
Figure 9:
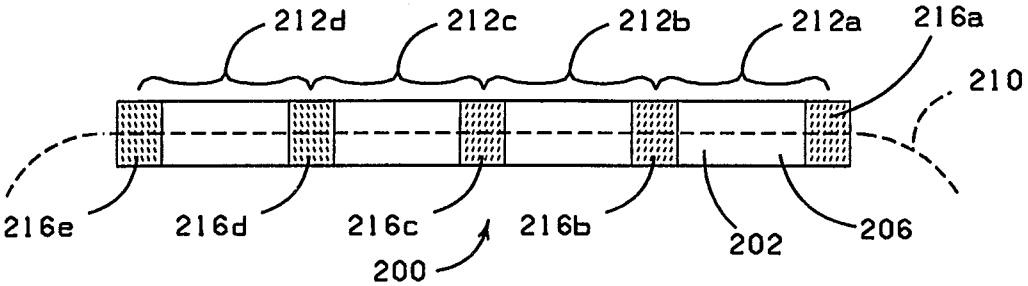
FIG. 9 is a plan view of an existing pull bow ribbon assembly constructed in any prior art manner having an improvement incorporated therein comprising an adhesive or cohesive disposed on the strip of material for adhesively or cohesively holding each curved segment in the curved form.

Shown in FIG. 9 is a pull bow ribbon assembly 200 comprising a strip of material 202 having an upper surface 204 (FIG. 10) and a lower surface 206 (FIGS. 9 and 10). Pull means 210 is connected to the strip of material 200 in such a manner that an individual pulls the pull means 210 and forms the strip of material 200 into a bow. The pull means 210 may comprise a string or ribbon for example.

Pull bows constructed in the manner just described are commercially available and well known in the art. Examples of such pull bows are described in U.S. Pat. No. 2,841,905, titled Bow and Method for Making Same, issued to G. Wanchek on Jul. 8, 1958; U.S. Pat. No. 2,849,821, titled Rosette Structure and Method of Making the Same, issued to S. H. Doig on Sep. 2, 1958; U.S. Pat. No. 2,869,264, titled Decorative Bow and Method of Making the Same, issued to A.E. Salmi on Jan. 20, 1959; U.S. Pat. No. 3,030,719, titled Flower Ribbon Strip, issued to Taiji Enomoto on Apr. 24, 1962; U.S. Pat. No. 3,041,765, titled Article and Method of Forming a Bow, issued to T. J. J. Paar on Jul. 3, 1962; U.S. Pat. No. 3,539,431, titled Decorative Ribbon and Bow, issued to R. M. Schmidt, et al. on Nov. 10, 1970; U.S. Pat. No. 3,632,464, titled Decorative Bow, issued to R. Grikis on Jan. 4, 1972; U.S. Pat. No. 3,637,455, titled Prefabricated Bow Forms, issued to Pearson, et al. on Jan. 25, 1972; U.S. Pat. No. 3,676,277, titled Decorative Bow and Method of Making Same, issued to B. S. Truskolaski on Jul. 11, 1972; U.S. Pat. No. 3,954,212, titled Method for Making Ribbons Curlable in a Cockade Fashion, issued to Bolis on May 4, 1976; U.S. Pat. No. 4,329,382, titled Self-Locking Ribbon Assemblies, issued to Truskolaski, et al. on May 11, 1982; U.S. Pat. No. 4,449,652, titled Prefabricated Bow Forming Machine, issued to Coppins, et al. on May 22, 1984; U.S. Pat. No. 4,476,168, titled Artificial-Flower-Forming Ribbon, issued to Aoyama on Oct. 9, 1984; U.S. Pat. No. 4,515,837, titled Ribbon for Forming a Decorative Bow, issued to Cheng on May 7, 1985; U.S. Pat. No. 4,585,676, titled Decorative Pull-String Bows, issued to DeSmet, et al. on Apr. 29, 1986; U.S. Pat. No. 4,608,283, titled Bag With Bow, issued to White on Aug. 26, 1986; U.S. Pat. No. 4,634,612, titled Decorative Ribbon and Sheet Material, issued to Nelson, et al. on Jan. 6, 1987; U.S. Pat. No. 4,656,064, titled Decorative Bow-Forming Ribbon Assembly, issued to Peter S. C. Cheng on Apr. 7, 1987; U.S. Pat. No. 4,684,552, titled Prefabricated Bow Form for a Pom Bow, issued to LaBrosse, et al. on Aug. 4, 1987; U.S. Pat. No. 4,724,175, titled Prefabricated Bow Form, issued to LaBrosse, et al. on Feb. 9, 1988; U.S. Pat. No. 4,725,461, titled Combination of Artificial-Flower-Forming Ribbon and Tack Plate, issued to Masui on Feb. 16, 1988; U.S. Pat. No. 4,777,066, titled Gift Bag With Decorative Self-Forming Bow, issued to White, et al. on Oct. 11, 1988; U.S. Pat. No. 4,812,338, titled Combination of Artificial Flower-Forming Ribbon and Tack Plate, issued to Masui on Mar. 14, 1989; U.S. Pat. No. 4,822,648, titled Decorative Bow Assembly and Method of Making Same, issued to Cheng on Apr. 18, 1989, all of these patents being specifically incorporated herein by reference.

The strip of material 200 is divided into a plurality of strip segments 212 with the individual strip segments being designated in FIG. 9 by the individual reference numerals 212*a*, 212*b*, 212*c* and 212*d*. The pull means 210 is attached to the strip of material 200 in such a manner that, when the pull means 210 is pulled, each of the strip segments 212*a*, 212*b*, 212*c* and 212*d* forms a curved segment 214 with the individual curved segments being designated in FIG. 9 by the individual reference numerals 214*a*, 214*b*, 214*c* and 214*d*. each of the curved segments 214 has a curved form or loop and cooperates with the other curved segments 214 to form the bow like structure shown in FIG. 10.

The pull bow ribbon assembly 200 includes the improvement of having an adhesive or cohesive 216 disposed on the strip of material 200 between each of the strip segments 212*a*, 212*b*, 212*c* and 212*d*. The adhesive or cohesive 216 is designated in FIG. 9 by the individual reference numerals 216*a*, 216*b*, 216*c*, 216*d* and 216*e*. each of the strip segments 212 has opposite ends and the opposite ends of each of the curved segments 212 are brought together when the curved segments 214 are formed by pulling the pull means 210. When the curved segments 214 are formed and the opposite ends of the strip segments are brought together, the adhesive or cohesive 216 adjacent each of the opposite ends of the curved segments 212 are brought into contact for adhesively or cohesively connecting the opposite ends of each of the strip segments 212 to hold each of the formed curved segments 214 in the curved form.

Changes may be made in the construction and the operation of the various components, elements and assemblies described herein and changes may be made in the steps or the sequence of steps of the methods described herein without departing from the spirit and scope of the invention as defined in the following claims.

What is claimed is:

1. A ribbon assembly comprising:

a strip of material having an upper surface and a lower surface and a strip width extending between a first strip side and a second strip side, the strip of material being divided into a plurality of strip segments with each strip segment having a first segment end and a second segment end with the second segment end of each strip segment being disposed about adjacent the first segment end of the adjacent strip segment;

elastic means disposed on the strip of material for substantially forming the strip of material into curved segments, the elastic means having a stretched condition and an unstretched condition, the strip of material being extendable in about a straight line in the stretched condition of said elastic means and said elastic means pulling the first segment end toward the second segment end of each strip segment to form each strip segment into (a) one of the curved segments wherein the portion of the strip of material defining each curved segment extends along a curved path in the unstretched condition of said elastic means.

2. The ribbon assembly of claim 1 wherein the elastic means having a stretched condition and an unstretched condition is an elastic band, the elastic band being connected to the lower surface of the strip of material at a plurality of connection points disposed between each of the segments.

3. The ribbon assembly of claim 2 wherein the elastic band is securedly connected to the lower surface of the strip of material at secure connection points disposed between some of the segments and loosely connected to the lower surface of the strip of material at loose connection points disposed between the remaining segments, the elastic band being slidably connected to the sheet of material at the loose connection points.

4. The ribbon assembly of claim 2 wherein the elastic band is defined further as being securedly connected to the lower surface of the strip of material at secure connection points disposed between adjacent strip segments.

5. The ribbon assembly of claim 1 defined further to comprise:

adhesive or cohesive means disposed on the strip of material for connecting the first segment end to the second segment end of each segment in the unstretched condition of said means for adhesively or cohesively securing each segment in the curved segment form.

6. The ribbon assembly of claim 1 wherein the strip of material is rollable into the form of a roll of the strip of material, and wherein the strip of material further comprises adhesive or cohesive means on the strip of material for cohesively or adhesively connecting portions of the strip of material to adjacent portions of the strip of material in the roll for cooperating to hold said means in the stretched condition while the strip of material is in the form of the roll, a portion of the strip of material being unrollable from the roll and cut therefrom to provide the strip of material for forming the bow.

7. The ribbon assembly of claim 1 wherein the strip of material is defined further to include a plurality of recess means formed in the first strip edge and in the second strip edge for cooperating to form the strip of material in the form of the bow.

8. The ribbon assembly of claim 1 wherein the means having the stretched condition and the unstretched condition is further defined as being automatically moved to the unstretched condition when released.

9. A ribbon assembly comprising:

a strip of material having an upper surface and a lower surface and a strip width extending between a first strip side and a second strip side, the strip of material being divided into a plurality of strip segments with each strip segment having a first segment end and a second segment end with the second segment end of each strip segment being disposed about adjacent the first segment end of the adjacent strip segment;

means disposed on the strip of material for substantially forming the strip of material into curved segments, the means having a stretched condition and an unstretched condition, the strip of material being extendable in about a straight line in the stretched condition of said means and said means pulling the first segment end toward the second segment end of each strip segment to form each strip segment into one of the curved segments wherein the portion of the strip of material defining each curved segment extends along a curved path in the unstretched condition of said means, the means having the stretched condition and the unstretched condition further comprising a heat shrinkable material, the heat shrinkable material being in the stretched condition prior to heat being applied thereto and the heat shrinkable material shrinking when heat is applied thereto for moving the heat shrinkable material to the unstretched condition.

* * * * *

UNITED STATES PATENT AND TRADEMARK OFFICE

CERTIFICATE OF CORRECTION

PATENT NO. : 5,387,446

DATED : February 7, 1995

INVENTOR(S) : Donald E. Weder

It is certified that error appears in the above-identified patent and that said Letters Patent is hereby corrected as shown below:

Column 3, line 39, please delete "lose" and substitute therefor -- loose --.

Column 3, line 59, please delete "slit" and substitute therefor -- slits --.

Column 4, line 36, please delete "bow segment 36" and substitute therefor -- bow segment 46 --.

Column 5, line 39, please delete "connections" and substitute therefor -- connection --.

Column 5, line 47, please delete "numeral" and substitute therefor -- numerals --.

Column 6, line 26, please delete "strip of material 200" and substitute therefor -- strip of material 202 --.

Column 7, line 15, please delete "strip of material 200" and substitute therefor -- strip of material 202 --.

Column 7, line 19, please delete "strip of material 200" and substitute therefor -- strip of material 202 --.

Column 7, line 24, please delete "each" and substitute therefor -- Each --.

UNITED STATES PATENT AND TRADEMARK OFFICE

CERTIFICATE OF CORRECTION

PATENT NO. : 5,387,446

DATED : February 7, 1995

INVENTOR(S) : Donald E. Weder

It is certified that error appears in the above-identified patent and that said Letters Patent is hereby corrected as shown below:

Column 7, line 30, please delete "strip of material 200" and substitute therefor -- strip of material 202 --.

Column 7, line 34, please delete "each" and substitute therefor -- Each --.

Column 7, line 35, please delete "curved segments 212" and substitute therefor -- strip segments 212 --.

Column 7, line 41, please delete "curved segments 212" and substitute therefor -- strip segments 212 --.

Column 8, line 4, please delete "(a)".

Signed and Sealed this

Twenty-fifth Day of April, 1995

Bruce Lehman

*Attest:*

BRUCE LEHMAN

*Attesting Officer*

*Commissioner of Patents and Trademarks*